United States Patent [19]

Clark

[11] 4,442,599

[45] Apr. 17, 1984

[54] SHARPENER CONSTRUCTION FOR FABRIC CUTTING MACHINE

[75] Inventor: Frederick G. Clark, Naples, Fla.

[73] Assignee: Eastman Machine Company, Buffalo, N.Y.

[21] Appl. No.: 320,724

[22] Filed: Nov. 12, 1981

[51] Int. Cl.[3] ..... B25F 3/00

[52] U.S. Cl. ..... 30/139; 51/247; 83/174

[58] Field of Search ..... 30/139, 273, 275; 83/174; 51/247, 249

[56] References Cited

U.S. PATENT DOCUMENTS

| | | | |
|---|---|---|---|
| 1,815,017 | 7/1931 | Wagner | 30/139 |
| 2,183,786 | 12/1939 | Clark | 30/139 UX |
| 2,282,918 | 5/1942 | Zawistowski | 51/249 |
| 3,233,371 | 2/1966 | Stucker | 51/249 |

*Primary Examiner*—Frank T. Yost
*Assistant Examiner*—Douglas D. Watts
*Attorney, Agent, or Firm*—Joseph P. Gastel

[57] ABSTRACT

A sharpener drive for the straight blade of a fabric cutting machine receives its motion from the crank wheel which drives the blade. A drive wheel, which selectively engages the crank wheel, drives a gear train which drives a gear mounted in splined relationship with an elongated shaft. A sharpener is mounted on the elongated shaft for selective engagement with the straight knife. An actuator is attached to the elongated shaft for sliding the elongated shaft through the gear with which it is splined to thereby move the sharpener axially of the knife while the gear rotates the elongated shaft to drive sharpener wheels. A link is engageable by the elongated shaft in its stored position for effecting disengagement of the drive wheel from the crank wheel. A latch includes a camming portion for moving the latch into locking engagement with the cutting machine housing when the elongated shaft is moved to its stored position. The sharpener consists of first and second sharpener wheels at a lower and higher elevations, the placement of the sharpener wheel at the lower elevation being for compensating for the upward movement thereof inherent in its linkage before it can engage the sharpener blade on the upstroke of the sharpener.

6 Claims, 15 Drawing Figures

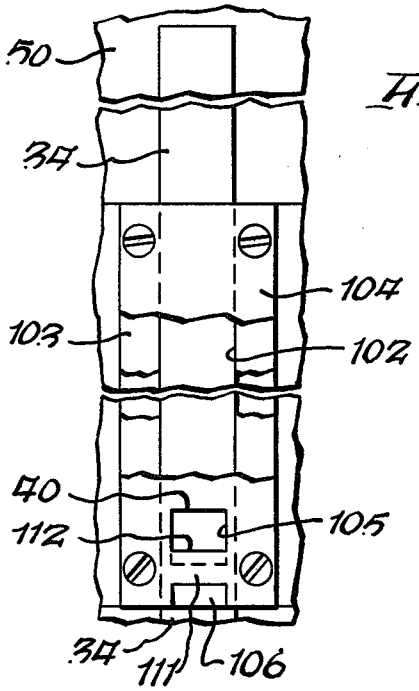
Fig. 11.
Fig. 13.
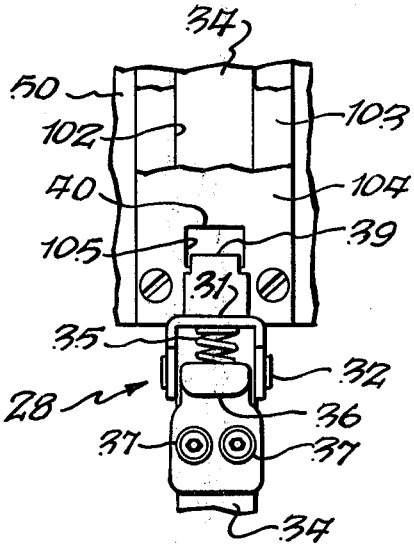
Fig. 12.
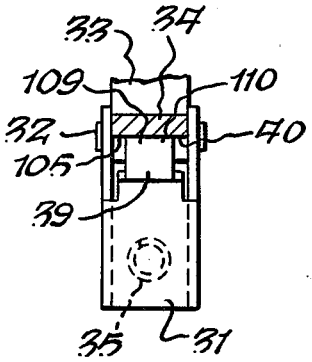
Fig. 4a.
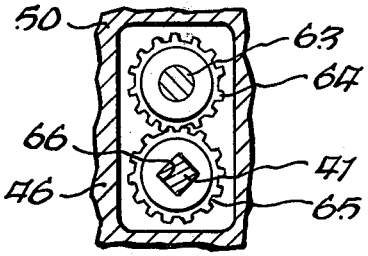

SHARPENER CONSTRUCTION FOR FABRIC CUTTING MACHINE

BACKGROUND OF THE INVENTION

The present invention relates to an improved sharpener construction for a fabric cutting machine.

By way of background, in certain types of fabric cutting machines, a reciprocating knife is driven by a motor. Periodically the knife has to be sharpened. Prior sharpening mechanisms included a pair of sharpener wheels on opposite sides of the blade, with mechanism for rotating the sharpener wheels and also for moving the sharpener wheels along opposite sides of the blade. However, prior constructions possessed certain deficiencies. The first deficiency was that the drive mechanism for driving the sharpener wheels was relatively complicated in that it included complex gear, pulley and rod arrangements for the purpose of transmitting motion from the cutting machine motor to the sharpener wheels. A second deficiency was that the sharpener wheels were so arranged so that both sides of the lowermost portion of the knife might not be sharpened. A third deficiency was that the arrangement for securing the sharpener mechanism in its non-operating position was relatively complex and required numerous manipulations on the part of the machine operator, which often resulted in improperly securing the sharpener mechanism when it was not in use. It is with overcoming the foregoing deficiencies that the present invention is concerned.

SUMMARY OF THE INVENTION

It is accordingly one object of the present invention to provide an improved highly simplified sharpener construction for a fabric cutting machine which utilizes an extremely simple drive linkage between the cutting machine motor and the sharpener wheels.

Another object of the present invention is to provide an improved sharpener construction for a fabric cutting machine wherein the sharpener wheels sharpen both sides of the blade to the very lowest end portion thereof.

A further object of the present invention is to provide an improved sharpener construction for a fabric cutting machine in which a latching mechanism is provided which automatically secures the sharpener mechanism in a dormant position without requiring any extra manipulations on the part of the machine operator, thereby insuring that it is safely locked, and which can be released with a simple pressing action. Other objects and attendant advantages of the present invention will readily be perceived hereafter.

The present invention relates to a sharpener drive for a fabric cutting machine having a straight blade comprising a housing, a crank wheel and associated linkage for driving said straight blade, a sharpener mechanism, a drive wheel, link means associated with said drive wheel, gear means coupled between said drive wheel and said sharpener mechanism for driving said sharpener mechanism, and a single shaft for both transmitting motion through said link means to effect selective engagement between said crank wheel and said drive wheel and for transmitting rotary motion from said gear means to said sharpener mechanism.

The present invention also relates to a sharpener drive as set forth in the immediately preceding paragraph wherein said sharpener mechanism comprises first and second sharpener wheels, actuating means for moving said sharpener wheels axially of said knife, means for alternately moving said first and second sharpener wheels into engagement with opposite sides of said knife including a second linkage which causes said first and second sharpener wheels to rise before said second sharpener wheel can engage said knife, said second sharpener wheel being located at a lower elevation than said first sharpener wheel to compensate for said rise produced by said second linkage.

The present invention also relates to a latch construction for the sharpener mechanism of a fabric cutting machine having a straight knife comprising a housing, a sharpener mechanism, link means for driving said sharpener mechanism axially of said knife, and latch means operatively coupled to said link means, and latch securing means on said housing for receiving said latch means when said sharpener mechanism is in a stored position.

The various aspects of the present invention will be more fully understood when the following portions of the specification are read in conjunction with the accompanying drawings wherein:

BRIEF DESCRIPTION OF THE DRAWINGS

FIG. 4*a* is a cross sectional view taken substantially along line 4*a*—4*a* of FIG. 4;

FIG. 11 is a fragmentary view taken in the direction of arrows 11—11 and showing the latch-locking structure on the housing;

FIG. 12 is a view taken in the direction of arrows 12—12 of FIG. 4 and showing a plan view of the latch and related structure with certain portions of the cutting machine structure omitted in the interest of clarity; and FIG. 13 is a view taken in the direction of arrows 11—11 of FIG. 1 and showing an end view of the latch structure.

DESCRIPTION OF THE PREFERRED EMBODIMENTS

Figure 1:
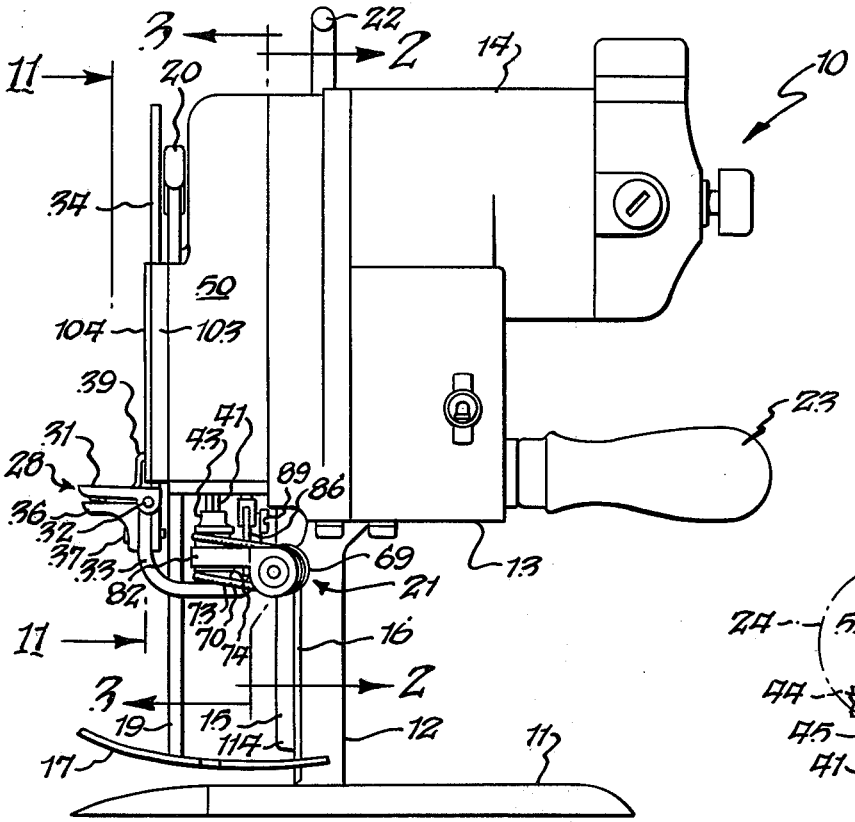
FIG. 1 is a side elevational view of the fabric cutting machine mounting the improved sharpener construction of the present invention.
Figure 2:
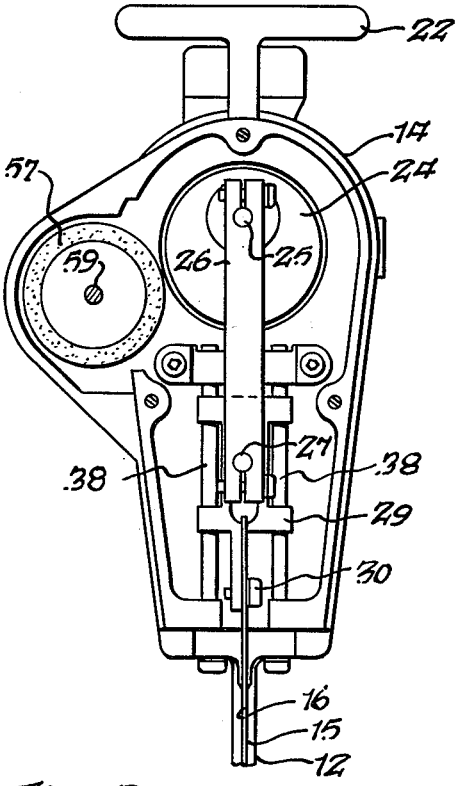
FIG. 2 is a fragmentary view taken substantially in the direction of arrows 2—2 of FIG. 1 and showing the drive linkage for the knife and also showing the position of the sharpener drive wheel in relation thereto.

The improved sharpener actuating linkage of the present invention is mounted on fabric cutting machine 10 which includes a roller-mounted base 11 which is adapted to rest on a table and moved about underneath a stack or lay of cloth to be cut. Rigidly affixed to and extending upwardly from base 11 is a standard 12, the upper end of which supports a frame 13 mounting a housing 14 which contains an electric motor (not shown) which reciprocates knife 15 in a vertical guide 16 mounted on standard 12. A presser foot 17 is rigidly secured to the lower end of vertical rod 19 which extends through a suitable slot (not shown) in the housing of the machine and terminates at a handle 20 which is used to move the rod up and down, as required, when a latching mechanism (not shown) is released, the latching mechanism also holding rod 19 in its adjusted position.

Normally the sharpening mechanism 21 is held in an elevated position immediately underneath frame 13 during the fabric cutting operation. However, it is periodically actuated to sharpen knife 15 in a manner to be described in greater detail hereafter. As is well understood, in use the machine 10 is guided in a desired path by an operator grasping handle 23.

The improved sharpening mechanism 21 of the present invention is actuated from the main drive of the machine which reciprocates knife 15. In this respect, the motor of the machine drives crank wheel 24 having an eccentric pin 25 on which is mounted one end of link 26 which has its other end mounted on pin 27 which is suitably connected to head 29 to which knife 15 is attached by means of screw 30. It can thus be seen that as crank wheel 24 rotates, knife 15 will reciprocate in guide 16 as head slides on guides 38.

Figure 4:
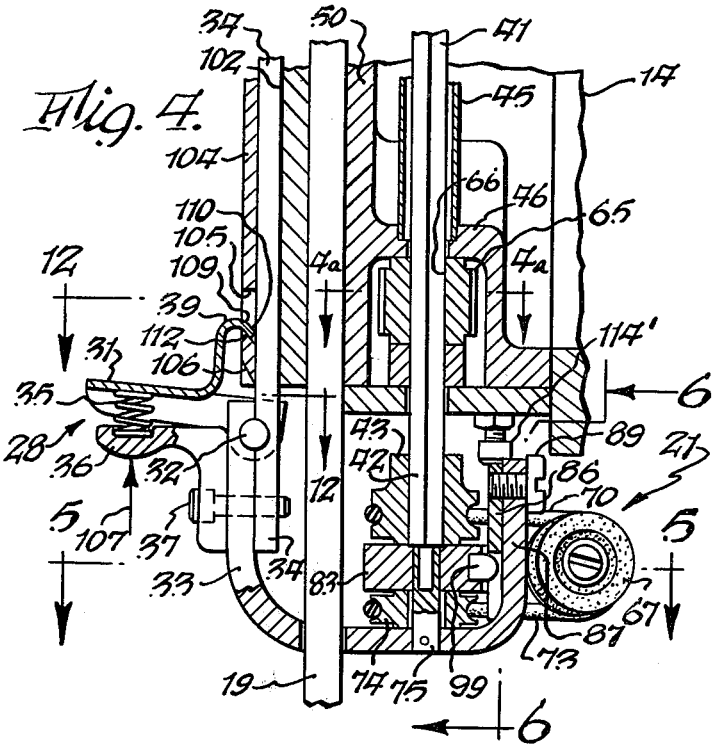
FIG. 4 is a fragmentary enlarged cross sectional view taken substantially along line 4—4 of FIG. 3 and showing details of the drive for the sharpener wheels and the details of the latching structure for retaining the sharpener wheels in a stored position and also showing the details of the actuating mechanism for reciprocating the sharpener wheels.

Periodically the knife sharpening mechanism 21 is reciprocated along the edge of knife 15 to sharpen it when it is not cutting cloth. To initiate the downward movement of sharpener mechanism 21, a novel construction, namely, knob 28 (FIG. 4) consisting of lever 31 and base 36 is grasped between the thumb and forefinger. Lever 31 is pivotally mounted by pin 32 located between link 33 and slide 34. A spring 35 is located between lever 31 and base 36 which is secured to link 33 by means of screws 37. The depressing of lever 31 against the bias of spring 35 will move latch 39 out of engagement with slot 40 so as to permit link 33 on which the sharpener mechanism 21 is mounted to move downwardly when a downward force is exerted on knob 28. Upon the downward movement of sharpener mechanism 21, there will be a corresponding downward movement of shaft 41 which is mounted in slidable splined relationship with gear 65 and which has its lower end 42 suitably secured in keyed relationship to pulley 43 (FIG. 4).

Figure 3A:
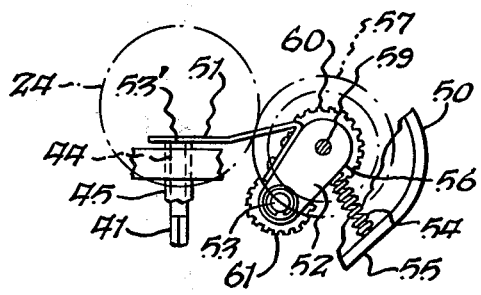
FIG. 3*a* is a fragmentary view of a portion of FIG. 3 with certain structure deleted to show a portion of the gear drive between the drive wheel and sharpener wheel.
Figure 3:
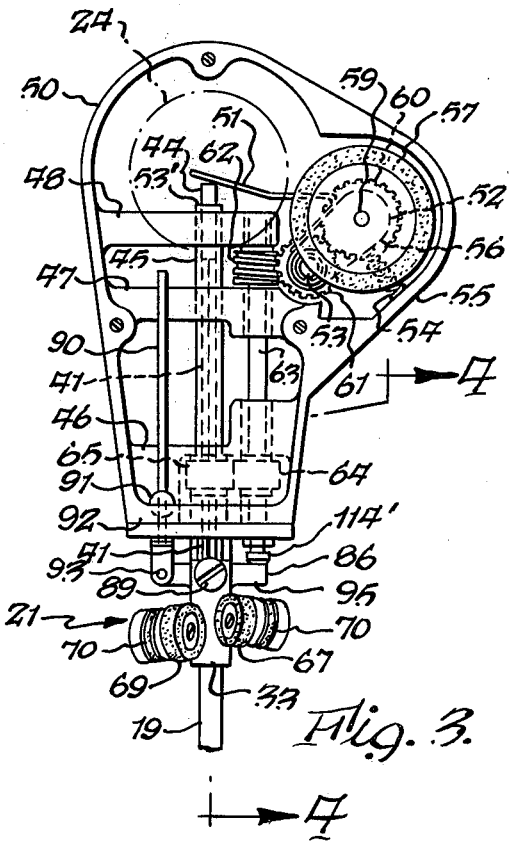
FIG. 3 is a view taken in the direction of arrows 3—3 of FIG. 1 and showing the improved sharpener drive of the present invention.

In accordance with one aspect of the present invention, elongated shaft 41 performs a plurality of functions, namely, (1) it is part of the linkage which transmits rotary motion from drive wheel 57 to the sharpener wheels 67 and 69, and (2) the upper end 44 of shaft 41 coacts with lever 51 to effect engagement and disengagement between crank wheel 24 and drive wheel 57. In the latter respect, the downward movement of shaft 41 will cause a corresponding downward movement of its upper end 44 (FIG. 3). The central portion of shaft 41 rides in tube 45 which is secured in bosses 46, 47 and 49 in housing 50. When upper end 44 moves downwardly, link or lever 51, which is secured to link 52, will also move downwardly until it engages the top 53' of tube 45 because link 52 will pivot in a counterclockwise direction about pin 53 under the urging of spring 54 which is interposed between the side 55 of housing 50 and the side 56 of link 52. This will cause drive wheel 57, which is mounted on shaft 59 on link 52, to be driven by crankwheel 24 when it engages the latter.

The transmission of rotary motion through elongated shaft 41 is effected by the following structure: A first gear 60 is coaxially mounted on shaft 59 with drive wheel 57 and is driven thereby. A second gear 61 is in mesh with gear 60 and is mounted on shaft 53. Gear 61 drives helical gear 62 which is keyed to shaft 63 which in turn is suitably journaled in bosses 47 and 46. A gear 64 is keyed to the lower end of shaft 63 and is in mesh with gear 65, both of said gears being housed in suitable cavities in boss 46. Gear 65 has a square hole 66 therein which slidably receives square shaft 41 in mating relationship to provide a slidable connection therewith. In essence, this connection is a splined connection. Therefore, as shaft 41 moves downwardly with sharpener mechanism 21, gear 65 will rotate shaft 41 to thereby rotate pulley 43 and thus provide a drive to sharpener wheels 67 and 69 mounted on the sharpener mechanism 21.

Figure 5:
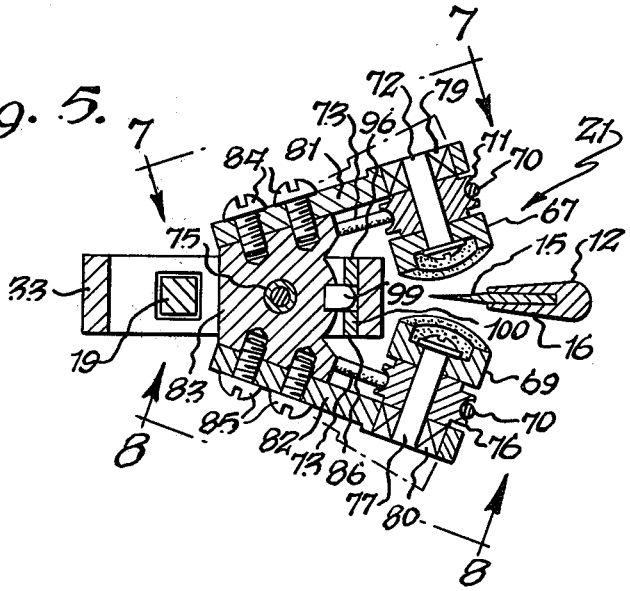
FIG. 5 is a cross sectional view taken substantially along line 5—5 of FIG. 4 and showing the drive for the sharpener wheels.

The conventional sharpener structure includes an endless belt 70 which is driven by pulley 43 and encircles pulley 71 which is keyed to shaft 72 on which sharpener wheel 67 is also mounted. The lower run 73 of belt 70 passes over pulley 74 which is journaled on shaft 75 which in turn is coaxial with shaft 42. The lower run 73 then passes around pulley 76 which is keyed to shaft 77 which in turn mounts sharpener wheel 69. Shafts 72 and 77 are suitably journaled in bearings 79 and 80, respectively, mounted on arms 81 and 82, respectively, which in turn are secured to block 83 (FIG. 5) by means of screws 84 and 85, respectively. It can thus be seen that endless belt 70 encircles pulleys 43, 71, 74 and 76 to drive sharpener wheels 67 and 69 while shaft 41 is being reciprocated by an operator manually grasping knob 28.

Figure 6:
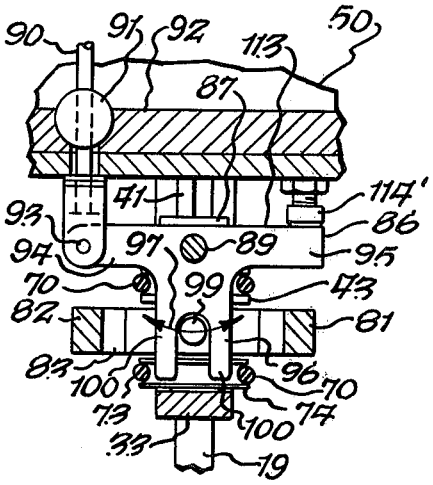
FIG. 6 is a fragmentary cross sectional view taken along line 6—6 of FIG. 4 and showing the mechanism for pivoting the sharpening wheels.

A conventional and well known mechanism is provided for causing alternate engagement of sharpener wheels 67 and 69 with opposite sides of knife 15. This mechanism includes a T-shaped link 86 (FIG. 6) which is pivotally mounted on the end 87 of link 33 by means of screw 89. A rod 90 extends with a friction fit through member 91 which is pivotally mounted in wall 92 of housing 50 (FIG. 6). The function of member 91 is to frictionally resist movement of rod 90. The lower end of rod 90 is pivotally connected at 93 to side 94 of T-shaped member 86. Thus, when the sharpener mechanism 21 is moved downwardly in FIG. 6, the frictional resistance applied to rod 90 by member 91 will cause the T-shaped member to pivot, and thus side 94 of member 86 will be elevated above side 95. When sharpener mechanism 21 is being moved upwardly, the reverse will be true. Thus the lower portion 96 of T-shaped member 86 will pivot back and forth in the direction of arrows 97 (FIG. 6). A protuberance 99 extends outwardly from member 83 (FIGS. 5 and 6) and is received between the tines 100 of member 86. Thus, as T-shaped member 86 oscillates back and forth in the direction of arrows 97, member 83 on which arms 81 and 82 are mounted will also oscillate back and forth on shaft 75 and will thus alternately bring sharpener wheels 67 and 69 into engagement with opposite sides of blade 15.

Figure 9:
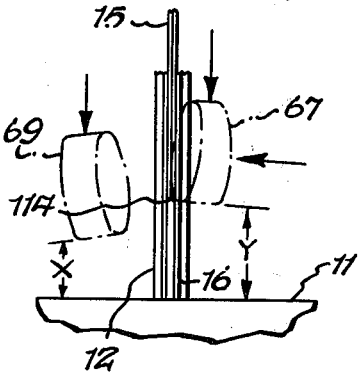
FIG. 9 is a schematic view showing one of the sharpener wheels in engagement with the lowermost portion of the knife at the bottom of the downstroke of the sharpener wheels.
Figure 8:
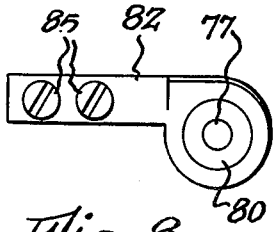
FIG. 8 is a view taken in the direction of arrows 8—8 and showing the elevation of the other of the sharpener wheels in relation to the sharpener wheel of FIG. 7.
Figure 7:
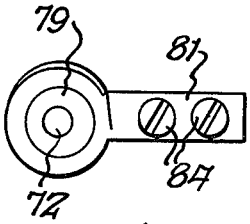
FIG. 7 is a side elevational view taken in the direction of arrows 7—7 and showing the elevation of one of the sharpener wheels.
Figure 10:
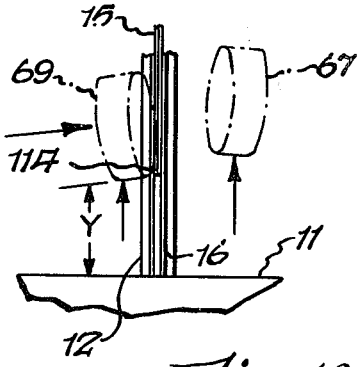
FIG. 10 is a schematic view similar to FIG. 9 but showing the other of the sharpener wheels in engagement with the opposite side of the lowermost portion of the knife at the beginning of the upstroke of the sharpener wheels.

In accordance with another aspect of the present invention, sharpener wheels 67 and 69 are mounted at different elevations (FIGS. 3, 9 and 10) for insuring that both sides of blade 15 are sharpened to their very lowermost ends. In this respect, the length of the linkages is such that on the down stroke as depicted in FIG. 9, upper sharpener wheel 67 will be in engagement with one side of knife 15 to its every end. When an upward force is applied to the knob 28, the first thing that happens is that the resistance to upward movement of rod 39 will cause the sharpener wheels 67 and 69 to shift from the position shown in FIG. 9 to the position shown in FIG. 10 before lower sharpener wheel 69 will engage the lowermost portion 114 of knife 15. In other words, as can be seen from FIG. 9, at the lowermost point of downward travel of the sharpener mechanism 21, lower sharpener wheel 69 will be at a distance X above base 11 and upper sharpener wheel 67 will be at a distance Y above base 11, at which time it will be in engagement with the lowermost portion of blade 15. Upon shifting of sharpener wheel 69 into engagement with blade 15 as a result of exerting an upward force on knob 28, the lower sharpener wheel 69 will rise to a position shown in FIG. 10 wherein it will be at the distance Y above base 11, and thus in engagement with the lowermost portion of blade 15. This action is inherent in the operation of the T-shaped linkage which causes movement of the sharpener wheels between the positions shown in FIGS. 9 and 10. However, because sharpener wheel 69 is located at a lower elevation than sharpener wheel 67, both of the wheels will engage the lowermost portion of knife 15 to thus sharpen both sides to the very bottom.

In accordance with a further aspect of the present invention, the above-mentioned latch arrangement both securely holds the sharpener mechanism in a stored position and also permits quick release thereof. At the termination of a knife sharpening operation it is merely necessary to exert an upward force in the direction of arrow 107 (FIG. 4) on base 36, without exerting any force whatsoever on lever 31. The tongue 109 which comprises the end of latch 39 has an upper surface 110 which will ride along cam surface 106 and then along surface 111 of plate 104. Thereafter tongue 109 will be biased into slot 105 by spring 35 and it will engage the edge 112 of slot 40 to retain link 33, and sharpener mechanism 21 supported thereby, in an elevated at rest position, as shown in FIGS. 1 and 4. In this position, the upper edge 113 of side 95 of T-shaped member 86 will engage the head of screw 114' to thus bring T-shaped member 95 to a perfectly horizontal position wherein sharpener wheels 67 and 69 will be held in the position shown in FIG. 5 wherein they do not engage knife 15. The rectilinear movement of sharpener mechanism 21, which is mounted at the end of link 33, is guided by slide 34 which is received in guideway 102 formed by member 103 and plate 104 which is secured to member 103. When latch 31 has been returned to the position shown in FIG. 4, rod 41 will be returned to the position shown in FIG. 3 wherein its upper end 44 will engage lever 51 to thus pivot link 52 in a clockwise direction about pivot 53 and thus move drive wheel 57 out of engagement with crank wheel 24.

While preferred embodiments of the present invention have been disclosed, it will be appreciated that the present invention is not limited thereto but may be otherwise embodied within the scope of the following claims.

What is claimed is:

1. A sharpener drive for a fabric cutting machine having a straight blade comprising a housing, a crank wheel and associated linkage for driving said straight blade, a sharpener mechanism, a drive wheel, link means associated with said drive wheel, gear means coupled between said drive wheel and said sharpener mechanism for driving said sharpener mechanism, and a single shaft for both transmitting motion through said link means to effect selective engagement between said crank wheel and said drive wheel and for transmitting motion from said gear means to said sharpener mechanism, said sharpener mechanism comprising first and second sharpener wheels, actuating means for moving said first and second sharpener wheels axially of said knife, means for alternately moving said first and second sharpener wheels into engagement with opposite sides of said knife including a second linkage which causes said first and second sharpener wheels to rise before said second sharpener wheel can engage said knife, said second sharpener wheel being located at a lower elevation than said first sharpener wheel to compensate for said rise produced by said second linkage.

2. A sharpener drive for a fabric cutting machine having a straight blade comprising a housing, a crank wheel and first linkage means for driving said straight blade, a drive wheel for selective engagement and disengagement with said crank wheel, an elongated shaft, first gear means mounted against axial movement on said housing and in splined relationship with said elongated shaft, second gear means for effecting a driving relationship between said drive wheel and said first gear means to thereby rotate said elongated shaft, sharpener means mounted in driving relationship with a first portion of said elongated shaft for selective engagement with said knife, actuating means for sliding said elongated shaft through said first gear means to thereby drive said sharpener means axially of said knife, and second linkage means engageable by a second portion of said elongated shaft at its limit of axial movement for effecting said selective engagement and disengagement between said crank wheel and said drive wheel, said second linkage means comprising a link pivotally mounted on said housing for mounting said drive wheel, a lever attached to said link for engagement by said second portion of said elongated shaft to thereby pivot said link and thereby move said drive wheel toward and away from said crank wheel, said second gear means comprising a first gear driven by said drive wheel, a second elongated shaft extending substantially parallel to said elongated shaft, a second gear at one end of said second elongated shaft for engagement with said first gear, and a third gear at the opposite end of said second elongated shaft for engagement with said first gear means.

3. A sharpener drive for a fabric cutting machine as set forth in claim 2 including third gear means between said drive wheel and said first gear.

4. A sharpener drive for a fabric cutting machine as set forth in claim 3 wherein said third gear means comprises a fourth gear between said drive wheel and said first gear.

5. A sharpener drive for a fabric cutting machine having a straight blade comprising a housing, a crank wheel and first linkage means for driving said straight blade, a drive wheel for selective engagement and disengagement with said crank wheel, an elongated shaft, first gear means mounted against axial movement on said housing and in splined relationship with said elongated shaft, second gear means for effecting a driving relationship between said drive wheel and said first gear means to thereby rotate said elongated shaft, sharpener means mounted in driving relationship with a first portion of said elongated shaft for selective engagement with said knife, actuating means for sliding said elongated shaft through said first gear means to thereby drive said sharpener means axially of said knife, and second linkage means engageable by a second portion of said elongated shaft at its limit of axial movement for effecting said selective engagement and disengagement between said crank wheel and said drive wheel, said sharpener means comprising first and second sharpener wheels, sharpener-mounting means mounting said first and second sharpener wheels on opposite sides of said blade for sharpening said blade on the downstroke and upstroke, respectively, pivot means for pivoting said sharpener wheels back and forth to alternately sharpen opposite sides of said blade, said second sharpener wheel being mounted at a lower elevation than said first sharpener wheel to extend below the lower end of said blade when said first sharpener wheel engages the lowermost portion of said blade, said pivot means including a connection which requires said sharpener wheels to move upwardly before said second sharpener wheel can engage said knife, said mounting of said second sharpener wheel below said first sharpener wheel compensating for the upward movement of said sharpener mounting means.

6. A sharpener drive for a fabric cutting machine having a straight blade comprising a housing, a crank wheel and associated linkage for driving said straight blade, a sharpener mechanism, a drive wheel, link means associated with said drive wheel, gear means coupled between said drive wheel and said sharpener mechanism for driving said sharpener mechanism, and a single shaft for both transmitting motion through said link means to effect selective engagement between said crank wheel and said drive wheel and for transmitting motion from said gear means to said sharpener mechanism, said sharpener mechanism comprising first and second sharpener means, actuating means for moving said first and second sharpener means axially of said knife, means for alternately moving said first and second sharpener means into engagement with opposite sides of said knife including a second linkage which causes said first and second sharpener means to rise before said second sharpener means can engage said knife, said second sharpener means being located at a lower elevation than said first sharpener means to compensate for said rise produced by said second linkage.

* * * * *